United States Patent [19]

Kade et al.

[11] Patent Number: 4,800,687

[45] Date of Patent: Jan. 31, 1989

[54] METHOD FOR CYLINDRICAL GRINDING OF ROLLS

[75] Inventors: Werner Kade; Theodor Bahr; Georg Zurn, all of Heidenheim; Gunter Rohde, Zang, all of Fed. Rep. of Germany

[73] Assignee: J. M. Voith, GmbH, Heidenheim, Fed. Rep. of Germany

[21] Appl. No.: 62,704

[22] Filed: Jun. 16, 1987

[30] Foreign Application Priority Data

Jul. 1, 1986 [DE] Fed. Rep. of Germany ..... 3621979

[51] Int. Cl.[4] ..... B24B 1/00

[52] U.S. Cl. ..... 51/289 R; 51/327

[58] Field of Search ..... 51/289, 291, 290, 281 R, 51/327

[56] References Cited

U.S. PATENT DOCUMENTS

| | | | |
|---|---|---|---|
| 1,923,146 | 4/1934 | Wood | 51/289 R |
| 3,802,044 | 4/1974 | Spillmann et al. | 29/113 AD |
| 4,187,594 | 2/1980 | Appenzeller | 29/116 AD |
| 4,188,698 | 2/1980 | Appenzeller | 29/116 AD |
| 4,291,447 | 9/1981 | Marchioro | 29/116 AD |
| 4,656,789 | 4/1987 | Schwär | 51/291 |

FOREIGN PATENT DOCUMENTS

| | | | |
|---|---|---|---|
| 2212073 | 3/1973 | Fed. Rep. of Germany | 51/289 R |
| 0019551 | 1/1986 | Japan | 51/289 R |

*Primary Examiner*—Frederick R. Schmidt
*Assistant Examiner*—Robert A. Rose
*Attorney, Agent, or Firm*—Albert L. Jeffers; Richard L. Robinson

[57] ABSTRACT

A roll assembly having a roll cylinder, a roll core and pressure transfer elements, which assembly is tightened for a grinding operation by applying hydraulic pressure through the pressure transfer elements and aligning the plane of the hydraulic overall pressure force to reduce to about zero the bearing play in the area of the contact line of the grinding wheel. The roll cylinder is mounted on the roll core through antifriction bearings, and in the finished apparatus, such as a calender, reduction of bearing play will compensate for wall thickness errors in the races of the antifriction bearings.

4 Claims, 1 Drawing Sheet

METHOD FOR CYLINDRICAL GRINDING OF ROLLS

The invention concerns a method for cylindrical grinding of a roll. More specifically the method is applicable to an assembly of a roll cylinder on a beam type roll core with antifriction bearings mounted on the assembly ends. The bearings' inner races are mounted on the roll core and the roll cylinder is mounted on the bearings' outer races. The roll cylinder is further supported on the roll core by pressurized hydraulic fluid provided through at least one pressure transfer element or a pressure chamber defined between the roll cylinder and roll core.

The German Patent Document No. 28 50 415 describes a so-called "floating" (mounted in floating fashion) roller, which has a roll cylinder with ball bearings on both its ends mounted and rotatable on a fixed roll core. The roll core supports at least one row of hydraulically actuated pressure rams extending parallel with the longitudinal axis of the roll, which rams act essentially parallel with one another. Alternatively the roll core may have a continuous, hydraulically actuated, pressure ram extending the length of the roll cylinder. The pressure rams have pressure pockets on their surface facing the roll cylinder and hydraulic fluid at an elevated pressure can be admitted to the pockets, thus allowing the roll cylinder to float. This, of course, is an inaccurate expression since the roll cylinder is essentially stressed by the fluid pressure in the pressure pockets. The fluid pressure directs a force on the roll cylinder toward an opposite roll, such as in calendering, for example. The device is also applicable to other apparatus, such as drying presses in the paper industry.

Rolls or roll cylinders mounted in antifriction bearings are not absolutely rotationally accurate as the wall thickness of antifriction bearings varies on the maximum order of 50 um about the bearing circumference. The bearing variation or error is transmitted to the roll cylinder as the rolls in the calender frame are pressing on one another along a certain line of force or contact line.

SUMMARY OF THE INVENTION

The above-noted bearing variation or error is overcome by the method of the present invention. The complete assembly, which includes the roll cylinder, roll core and mounted antifriction bearings, is finish ground while a hydraulic fluid pressure is provided at the pressure transfer elements. The method uses a roll core radius extended to the contact point with the grinding wheel, and a second radius extending through the pressure transfer elements. The second radius is displaced from the contact point radius and a fluid pressure is applied to compensate for the angular displacement of the roll cylinder from its own weight. The wall thickness error of the bearing races is transmitted to the roll cylinder and is balanced or equalized (i.e., in the opposite direction) during the grinding operation, thus accurately simulating the installation conditions of the finished calender system and eliminating the bearing play at the contact line of the grinding wheel. The finished or ground assembly essentially eliminates or negates the effect of the runout. The applied hydraulic fluid pressure at the pressure transfer elements causes a deflection of the roll cylinder during the grinding operation. Therefore, a corresponding added ovalization, or in the case of perfectly cylindrical roll cylinders a corresponding ovalization, is provided to the grinding wheel control.

BRIEF DESCRIPTION OF THE DRAWINGS

In the several FIGURES of the drawings, like reference numerals identify like components, and in the drawings.

DETAILED DESCRIPTION OF THE INVENTION

Figure 1:
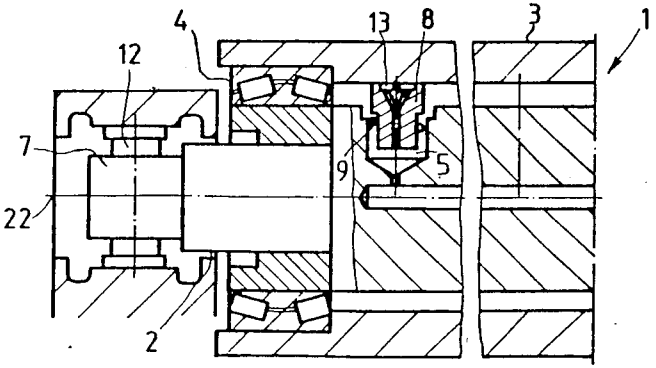
FIG. 1 is a longitudinal cross-sectional view at one-end of the floating roll assembly.

Assembly 1 in FIG. 1 includes roll cylinder 3 and roll core 2 with collars 7 at its ends, which collars 7 are used for mounting the assembly for both the production operation and the grinder. Roll core 2 has antifriction bearings 4, which are shown as double roller bearings, mounted on both ends. Roll core 2 is positioned in roll cylinder 3, which roll cylinder 3 is mounted on bearings 4 at both ends of roll core 2. Roll core 2 has a row of bores or recesses 5 serving as pressure spaces for pressure transfer elements, which are illustrated as individual pressure rams 8. Seals 9 are provided between the piston part of the rams 8 and the wall of recess 5. Pressure pockets 13 on the surface of rams 8 receive a pressure medium from pressure spaces 5 to support roll cylinder 3 in the production and grinding operations.

Figure 2:
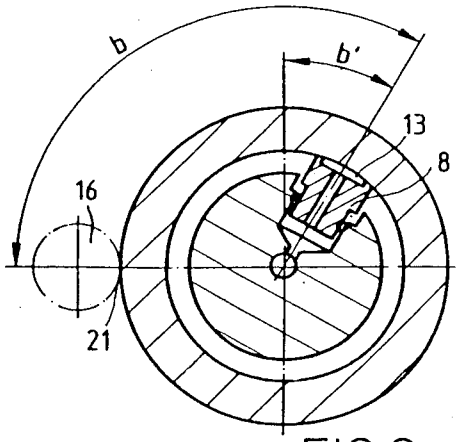
FIG. 2 is a transverse cross-sectional view of the roll core and roll cylinder assembly through a pressure transfer element.
Figure 4:
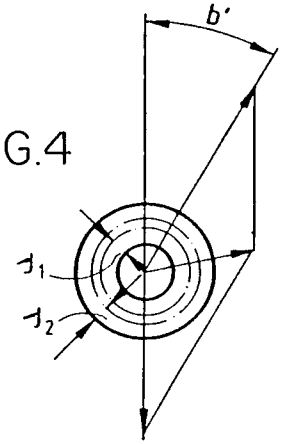
FIG. 4 is a sketch illustrating the relative roll geometry and includes a force parallelogram; and, FIG. 5 is a cross-sectional view of another roll arrangement.

FIG. 2 illustrates in cross-section a relative relationship between grinding wheel 16 and the roll assembly 1. In FIG. 2 a certain small acute angle b' is shown between a vertical plane extending through longitudinal axis 22 of the roll arrangement and the plane extending through the center axes of rams 8 (plane of the hydraulic pressure force), which angle is about between 3° and 10°. FIG. 4 shows a force parallelogram and a resultant pressure force from the dead weight of the roll cylinder and the hydraulic pressure force, which at least compensates for the dead weight of the roll and additionally exerts a force on the roll cylinder 3 directed away from grinding wheel 16. The resultant force causes roll cylinder 3 to force the outer race of the friction bearing toward the bearing inner race such that at or in the plane extending through the contact line 21 of grinding wheel 16 and the longitudinal axis 22 of roll arrangement 1 the bearing play will be essentially eliminated or reduced to zero.

The total wall thickness error from the circumferential error of the wall thickness, s1, (cf. FIG. 4) of the inner race and the wall thickness error, s2, of the outer race transfers to the wall thickness of the roll cylinder during the grinding operation, as viewed across its circumference. The overall wall thickness variations are compensated to zero at any point. A transmission (not shown) drives roll cylinder 3 on the grinder, that is rotates cylinder 3 on roll core 2. In the grinding operation, the pressure of the hydraulic pressure medium is not very high and only ranges over approximately 1.5 bars absolute.

Figure 3:
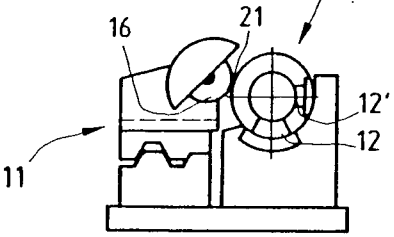
FIG. 3 is an end view of a roll assembly mounted in a representative roll grinder.

Roll grinder 11 in FIG. 3 has mounting devices on both ends of the roll assembly to be ground. Roll 1 is held in the mounting devices by bearing rams 12 and 12', which are provided with bearing metal.

Angle b' in FIGS. 2 and 4 will change within certain limits depending upon the angle of plane 21–22 relative to the horizontal. The shift of plane 21–22 is dependent upon the height of contact line 21 on grinding wheel 16.

Figure 5:
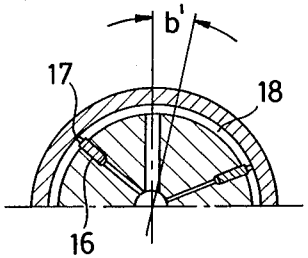

The pressure elements, illustrated as pressure rams 8 in FIG. 1, may also include a continuous pressure bar, which is described in the German Patent Publication No. 22 30 139 or the German Patent Publication No. 24 20 324. However, pressure chamber 18 in FIG. 5, which is a pressure-generating hydraulic (hydrostatic) element, may be defined between roll cylinder 3 and roll core 2, through seals 17 and sealing walls 16, across the supporting length of the roll cylinder (refer to FIG. 5 and German Patent Publications Nos. 27 31 365 or 27 54 380).

While this invention has been described in connection with certain specific embodiments thereof, it is to be understood that this is by way of illustration and not by way of limitation; and the scope of the appended claims should be construed as broadly as the prior art will permit.

What is claimed is:

1. A method for grinding a cylindrical roll assembly for a paper mill on a grinder having a grinding wheel and support devices, said cylindrical roll assembly having a beam type roll core with axial ends and an outer roll cylinder mounted on said roll core, which roll core and roll cylinder have a longitudinal axis and a collar at each roll core end, said assembly further having hydraulic support means for supporting said roll cylinder essentially in a radial direction along the length of said roll core and, antifriction bearings having an inner race and an outer race, one of said bearings mounted on each of said axial ends with said inner race on said roll core and said cylinder roll on said outer race;

said method comprising the steps of:

(a) mounting said roll assembly at said collars on said grinder support devices:

(b) moving said grinding wheel to contact said roll cylinder and to define a contact line, which contact line and longitudinal axis cooperate to define a plane;

(c) providing hydraulic fluid at a pressure to said pressure transfer elements, which hydraulic pressure produces a force acting in a plane;

(d) rotating said roll core to an angular position such that the hydraulic pressure force is at an angle to the plane defined by the contact line and the longitudinal axis;

(e) securing the roll core in a selected position on said grinder for balancing the hydraulic pressure force to counteract the weight of said roll and to thus essentially eliminate antifriction bearing play prior to grinding, the selected position being substantially similar to the operational orientation of the roll core;

(f) finish grinding said assembly to eliminate the effect of runout.

2. A method for grinding a cylindrical roll assembly as claimed in claim 1 and further comprising:

(a) defining a vertical plane through and including said longitudinal axis; and (b) rotating said roll core to move said hydraulic pressure force plane to an angle between 3° and 8° from said vertical plane.

3. A method for cylindrical grinding of a roll having an outer roll cylinder mounted at the axial ends thereof on a beam type roll core by antifriction bearings having an outer race fixed to the roll cylinder and an inner race fixed to the roll core, the roll cylinder being hydraulically supported thereon in a radial direction be at least one hydraulic pressure transfer element between the roll core and the roll cylinder, comprising the steps of:

(a) securing the roll core against rotation in an orientation substantially similar to the operational orientation of the roll core, in which orientation the pressure transfer element exerts a hydraulic pressure force radially against the cylinder roll at an angle such that the resultant force of the line loads from the dead weight of the roll cylinder and the hydraulic pressure force is oriented radially inwardly, whereby bearing play of the antifriction bearings along the resultant force radius is substantially zero; and (b) rotating the roll cylinder with respect to the roll core and grinding the roll cylinder along a contact line intersecting the resultant force radius.

4. The method according to claim 3, in which the hydraulic pressure force is exerted at an angle between 3° and 8° from vertical.

* * * * *